United States Patent [19]

Mathews

[11] 4,345,846

[45] Aug. 24, 1982

[54] IMPACT PRINTER WITH DUAL HELIX CHARACTER PRINT ELEMENTS

[75] Inventor: Raymond D. Mathews, Round Rock, Tex.

[73] Assignee: International Business Machines Corporation, Armonk, N.Y.

[21] Appl. No.: 193,879

[22] Filed: Oct. 3, 1980

[51] Int. Cl.[3] ..... B41J 1/32

[52] U.S. Cl. ..... 400/157; 101/93.23

[58] Field of Search ..... 101/93.23, 95, 96, 97, 101/99, 100, 101, 106, 107, 108, 110; 400/149, 150, 151, 151.1, 157, 171

[56] References Cited

U.S. PATENT DOCUMENTS

| | | | |
|---|---|---|---|
| 1,341,021 | 5/1920 | Robbins | 101/110 |
| 1,781,793 | 11/1930 | Spencer | 101/99 X |
| 2,843,243 | 7/1958 | Masterson | 400/157 |
| 3,133,499 | 5/1964 | Tringali | 101/297 |
| 3,232,403 | 2/1966 | Hebel | 400/70 |
| 3,356,199 | 12/1967 | Robinson | 400/144.3 |
| 3,599,772 | 8/1971 | Comstock | 101/93.23 X |
| 3,643,596 | 2/1972 | Vorbach et al. | 101/93.19 |
| 3,724,631 | 4/1973 | Kaczeus | 400/157 |
| 3,750,794 | 8/1973 | Griggs, Jr. | 400/157 |
| 3,896,919 | 7/1975 | Hutley | 400/157 |
| 3,908,809 | 9/1975 | Beattie | 400/144.3 |
| 3,913,722 | 10/1975 | Bowdle et al. | 101/93.23 X |
| 3,924,725 | 12/1975 | Kuhn et al. | 400/144.3 |
| 4,138,942 | 2/1979 | Hutley | 101/93.08 |
| 4,178,108 | 12/1979 | Kane | 400/144.2 |
| 4,230,039 | 10/1980 | Mizutani et al. | 101/110 X |

OTHER PUBLICATIONS

Pawletko et al., IBM Technical Disclosure Bulletin, vol. 19, No. 9, Feb. 1977, pp. 3355–3356, "High Speed Printer".

*Primary Examiner*—Edgar S. Burr
*Assistant Examiner*—C. A. Pearson
*Attorney, Agent, or Firm*—J. B. Kraft

[57] ABSTRACT

An impact printer is provided with a print member which comprises a first helical element having a first font of type characters arranged around its periphery; this first helical element is rotatably mounted so as to be linearily movable along an axis adjacent to a print medium. The print member further includes a second helical element having a second font of type characters arranged around its periphery, and this second helical element is rotatably mounted along the same axis in a position interspaced with the first helical element so as to be rotatable and linearily movable along the axis independent of the first helical element. The print member further includes means for rotating the first and second helical elements.

8 Claims, 3 Drawing Figures

IMPACT PRINTER WITH DUAL HELIX CHARACTER PRINT ELEMENTS

BACKGROUND OF THE INVENTION

1. Field of the Invention

The present invention relates to impact printers wherein the print member is moved relative to the printing medium and impact printing is carried out at a plurality of print positions along a lateral line on said printing medium by moving said print member so that a selected type character on said print member coincides with a particular print position and then impacting said character against said print medium through a suitable ink release ribbon or sheet.

2. Background and Prior Art

In the impact printer field, there has been an ever-increasing demand for higher and higher printing speeds in excess of 50 characters per second. In accordance with the present state of the art, printers which utilize rotating disks with characters arranged on the periphery thereof have been extensively used commercially. These printers generally fall into the daisy wheel class of printers in which print elements have a plurality of type characters respectively arranged mounted at the ends of a corresponding plurality of spokes or petals extending from a central hub. U.S. Pat. Nos. 4,178,108, 4,189,246, 3,858,509 and 4,044,880 are directed to impact printers using such print wheels. Printers of this type are presently in use with considerable commercial success.

However, this group of impact printers appears to have upper limitations in print speed. It is believed that current daisy wheel impact printers have upper speed limitations in the order of 90–100 cps.

In order to achieve high speed impact printing in excess of 100 cps, the present invention, in effect provides a new technology in impact printers by providing print members having a plurality of interspaced small diameter helices.

In this connection, it should be noted that print elements utilizing a plurality of discrete helices are known in the impact printer art. U.S. Pat. No. 3,724,631, "Printer with Helically Arranged Type Divided into Axially Offset Group," S. L. Kaczeus, issued Apr. 3, 1973 and U.S. Pat. No. 4,138,942, "Printing Device for Printing on a Continuously Moving Form," R. Hutley, issued Feb. 13, 1979. Each disclose print members comprising a plurality of helical elements each having a font of type characters peripherally arranged thereupon. However, in the structures of this prior art, no two of the helices are interspaced with each other, and consequently as will be set forth hereinafter in greater detail, it is not possible to structure helical elements in the patented apparatus into small radius and consequently low inertia print elements.

BRIEF DESCRIPTION OF THE PRESENT INVENTION

The present invention provides a helical, low inertia print member for an impact printer. The print member comprises a first helical member having a first font of type characters arranged around its periphery; this first helical member is rotatably mounted so as to be linearly movable along an axis parallel and adjacent to a print line on a print medium. A second print element also having a second font of type characters arranged around its periphery is rotatably mounted along said axis in a position interspaced with the first helical print element so as to be rotatable and linearly movable along said axis independent of the first helical element. The print member further includes means for rotating said first and second helical elements independent of each other.

A print hammer is provided which is linearly movable along said print line and is adapted to drive selected type characters from said first and second fonts against said print medium at a plurality of predetermined positions along said print line.

Because of the interspaced relationship between said first and second print elements, the impact printer operates so that while a selected character on one of said helical elements is being impacted against the print medium, the other of said print elements is being rotated so as to move next selected character into the next print position whereupon the hammer is moved linearly to said next print position and then impacts said next selected character against the print medium while the first of said helical elements proceeds through a selection phase to rotate the next successive print character into the next successive print position and so on with the respective helical elements alternating between a character selection phase when one of said helical elements is rotating to select while the other is stationary to print followed by the next phase when said one print element is stationary to print while the other is rotated to select.

In this manner, the printing speed of the impact printer is substantially increased since the character select time, conventionally the slowest operation in a high speed printer, is virtually cut in half by being overlapped with the print cycle.

An additional advantage of the interspaced helical print element structure of the present invention is that such a structure permits each of the character fonts to be arranged over a plurality of turns in the helix. Because of this arrangement, the radius of the helical element containing the font may be substantially reduced. Since the inertia of a rotatable print element is directly related to the radius, such a reduction in the radius substantially reduces the inertia of the print element and thereby further reduces the selection time since the print element can be more quickly stopped when the selected character is reached.

To elaborate on this point, attention is directed to prior art U.S. Pat. Nos. 3,724,631 and 4,138,942 mentioned hereinabove. In the impact printers of these prior art patents, although they contain a plurality of independently rotatable font supporting helical elements, no two elements are interspaced with each other. As a result, the entire character font must be arranged around a single turn, i.e., there can be no overlapping of turns. Consequently, the diameter of each font supporting element and thus its inertia are relatively large. Thus, selection times are substantially greater than with the structure of the present invention.

Accordingly, the present invention provides an impact printer having a print member comprising a helical element having a font of type characters arranged around its periphery extending through a plurality of turns in said helix.

BRIEF DESCRIPTION OF THE DRAWINGS

Referring now to the drawings, wherein a preferred embodiment of the invention is illustrated, and wherein like reference numerals are used throughout to designate like parts.

DETAILED DESCRIPTION OF THE PREFERRED EMBODIMENT

Figure 2:
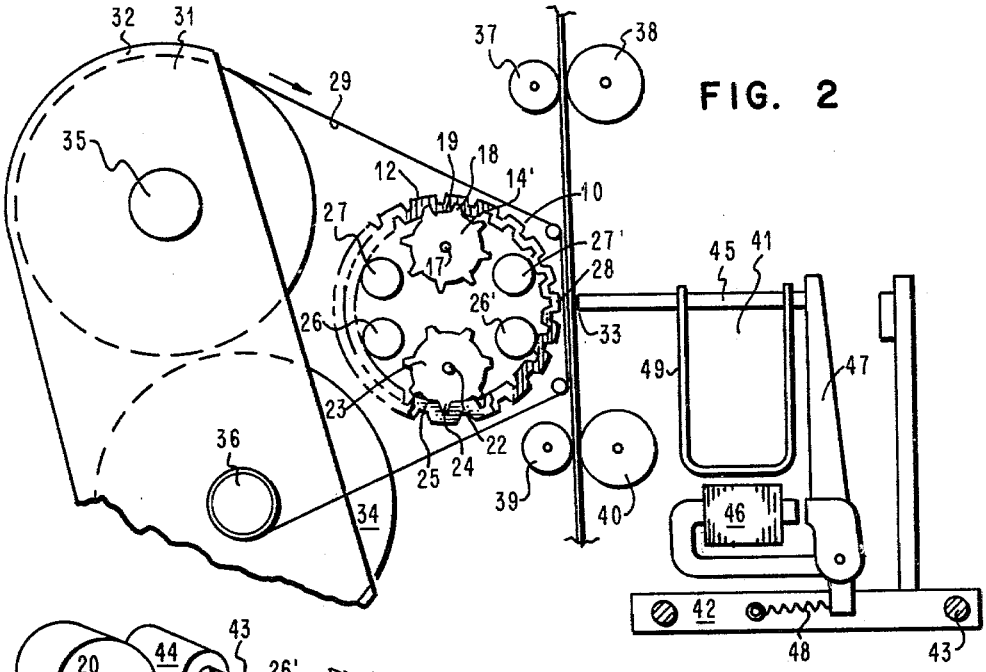
FIG. 2 is a diagrammatic lateral cross-section of the printer apparatus taken along lines 2, 2 of FIG. 1 but containing additional diagrammatic elements illustrating paper feed and ribbon feed.

In order to illustrate the operating concepts of the preferred embodiment in as simple a form as possible, repetitive details of the apparatus of the present invention as shown in the figures have been eliminated or shown in a generalized fashion. When drawings are read together with this description, instances where repetitive details have been eliminated will be clear. First, with reference to FIGS. 1 and 2 the print member 10 of the present invention comprises a first helical element 11 interspaced with a second helical element 12. Each of the two helical elements comprises a font of type characters formed around the periphery thereof. For purposes of simplification, the fonts of type characters have only been shown along small portions of each of the helical elements, for example, along portion 13 of the first helical element and along portions 15 and 16 of the second helical element. However, it should be understood that these two respective fonts of characters would extend over substantially the entire periphery of said first and second helical elements. Gears 14, 14', 14'' and 14''' which are fixed to rotatable shaft 17 have teeth 18 which engage corresponding teeth 19 formed along substantially the entire inner periphery of the second helical element 12. Here again, for purposes of simplification, only a small portion of the teeth 19 formed along the inner periphery of second helical element 12 have been shown. However, it should be understood that these teeth are formed along substantially the entire inner periphery of the second helical element 12. Motor 20 which conveniently can be a stepper motor rotates shaft 17 which in turn rotates gears 14-14''' to drive, i.e., rotate and thus linearly move second helical element 12.

Figure 1:
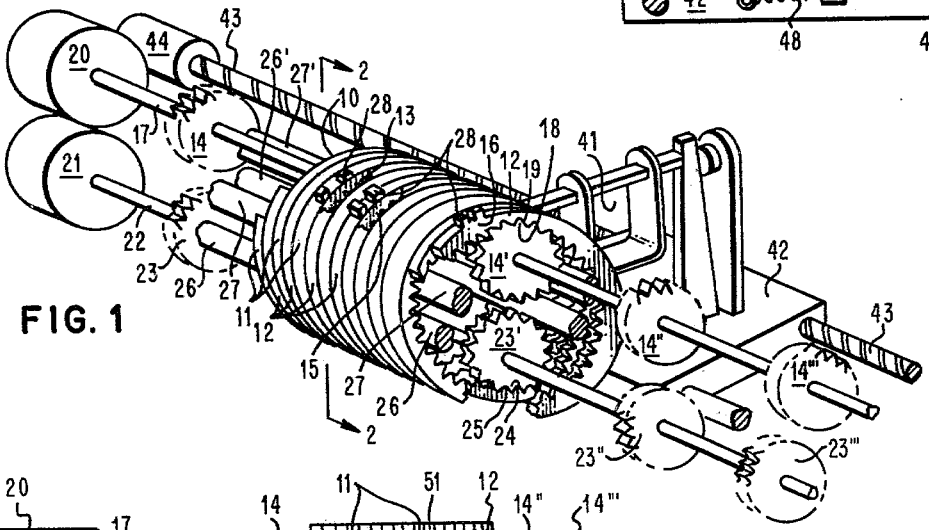
FIG. 1 is a fragmentary generalized view of an impact printer in accordance with the present invention with appropriate sections broken away to illustrate the novel print member of the present invention.

The first helical element 11 is similarly driven, i.e., motor 21 rotates shaft 22 which has affixed thereto gears 23-23''' which engage only first helical element 11 through gear teeth 24 formed on gears 23-23''' which engage corresponding teeth 25, only a small segment of which are shown in FIG. 1 but which extend throughout the entire inner periphery of first helical element 11.

The drive mechanism of said first helical element 11 and said second helical element 12 is more clearly shown with respect to FIG. 2 which is a diagrammatic side section of the apparatus of FIG. 1. The engagement of one of the drive gears 14' with second helical element 12 and one of the bottom drive gears 23' with first helical element 11 is shown. In order to show the engagement of drive gear 23' with first helical element 11, a portion of second helical element 12 has been broken away. In order to stabilize print member 10, the two helical elements slide along two pairs of bearing shafts 26 and 26' and 27 and 27'. These bearing shafts, only portions of which are shown in the figures, are mounted in the frame of the printer (not shown) so as to form stationary stable support along which both helical print elements may slide and rotate along a consistent and steady helical path.

The actual impact printing, i.e., the driving of the type characters 28 arranged around the periphery of the helical element against a printing medium such as a sheet or web of paper may be carried out in any convenient conventional manner. One standard method which may be conveniently used with the print member of the present invention is backside printing which is best illustrated with reference to FIG. 2. The ribbon web 29 which is stationary and is as wide as a whole print line on paper sheet or web 30 extends from a ribbon supply 31 supported on a ribbon supply spool 32 running across the print line 33 to a take-up spool 34. Ribbon supply and take-up spools which are respectively mounted on rotatable shafts 35 and 36 may be rotated in any conventional ribbon feed manner. Alternatively, the ribbon which is used in the printer of the present invention may be an off-the-carrier ribbon of the type described in the copending application of the present inventor, "Off-the-Carrier Ribbon Feed and Drive on a High Speed Movable-Carrier Impact Printer," Ser. No. 021,405, filed Mar. 19, 1979, now U.S. Pat. No. 4,264,224. Such an off-the-carrier ribbon feed mechanism would run the ribbon substantially along print line 33 between paper sheet 30 and print member 10.

Paper sheet 30 will be indexed from print line to print line by drive roller pairs 37 and 38 and 39 and 40. As the paper feed operation may be any standard feed or indexing operation, known to those skilled in the art, it need not be described here in detail. When the paper is indexed to the next print line 33, the printing will be accomplished through any conventional impact hammer mechanism such as hammer assembly 41. The assembly is mounted on a carrier 42 which is stepped along print line 33 by escapement lead screw 43 driven by escapement stepper motor 44 in the conventional manner to step hammer 45 through a plurality of print positions along print line 33. The means for firing the hammer at each print position are conventional. In the structure shown, they consist of coil member 46 which is selectively activated through the application of current by conventional means (not shown) during a firing cycle to attract the actuator arm 47 to drive hammer 45 against sheet 30 which in turn will drive the sheet against ribbon 29 to cause an imprint on the back of sheet 30 opposite the hammer of the selected one of type characters 28 to imprint the back of the sheet. At the end of the hammer firing cycle, coil 46 is deactivated permitting arms 49 spring loaded by retract spring 48 fixed to carrier 42 to be retracted. With arms 47 retracted, spring arm assembly 49 urges hammer 32 into the initial rest position shown in FIG. 2.

Figure 3:
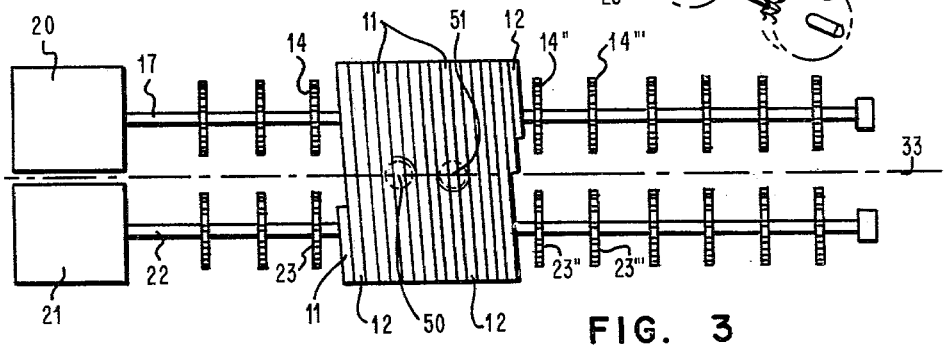
FIG. 3 is a partial longitudinal diagrammatic front view of the apparatus of FIG. 1, with selected elements removed for clarity of illustration.

Now with reference to FIGS. 1 and 3, the movement of the helical print elements 11 and 12 along a print line 33 with respect to hammer 45 will be described. As previously mentioned, a series of regularly spaced gears mounted on rotatable shaft 17 of which gears 14-14''' are numbered examples engage and drive second helical print element 12 in response to the rotation of shaft 17 by step motor 20. Similarly, a series of regularly spaced gears mounted on lower shaft 22 of which gears 23-23''' are numbered examples engage and rotate first helical print element 11 in response to the rotation of shaft 22 by step motor 21. Let us assume that the next print position to be impacted by print hammer 45 along print line 33 is the circled position 50 indicated in FIG. 3. Accordingly, when the print hammer is impacting a character at the previous print position, step motor 20 is rotating shaft 17 to cause gears 14-14''' to drive the second helical print element 12 so as to rotate this helical element through print position 50 until the selected type character from the font on the periphery of helical print element 12 is at position 50. Then, by the time the selected type character on helical element 12 has reached print position 50, escapement stepper motor 44 rotates lead screw 43 to step the hammer assembly so that print hammer 45 now coincides with print position 50 at which point, hammer 45 is driven as previously described to print selected type character on second helical print element 12 at print position 50.

While this impact printing step is being carried out at print position 50, the first helical print element 11 which had been quiescent or stationary during the previous rotation of second helical print element 12, commences its rotation immediately upon the completion of the rotation of second helical print element 12. First helical print element 11 which is engaged by a plurality of gears 23-23''' is rotated upon the rotation of shaft 22 by step motor 21 through the next succeeding print position 51 along print line 33 until the next selected type character to be printed from the font on first helical print element 11 coincides with print position 51 whereupon hammer 45 is actuated as previously described to print this next selected type character. In this manner, printing is continued along the print line 33. With alternative print positions along this line being printed upon with type characters alternatively from the first and second helical print elements 11 and 12. Thus, printing is speeded up since during the period when one of the helical elements is being impacted, the next character to be printed is being selected from the other helical print element. When the end of print line 33 is reached, the paper 30 is indexed by drive roller pairs 37, 38 and 39, 40 in the conventional matter to the next print line and the same printing operation is again commenced. It should be noted that the printing may be bidirectional.

It should be noted that drive gears 14-14''' and 20-20''' should be spaced along their respective shaft at positions sufficiently close that said first and second helical print elements 11 and 12 will each engage at least a pair of the gears. In other words, when a helical print element is moved sufficiently far along a print line so that it disengages the preceding gear of a pair, it will already have reached next succeeding gear so that the requisite engagement with a pair of gears is always maintained.

In the preceding description of the present invention, all of the novel aspects of the structure have been described in detail. On the other hand, whatever would be standard to those skilled in the art has only been described in a limited fashion. The state of the art expedient for controlling the escapement, the hammer firing and character selection and for coordinating these two operations have been described in detail in prior art patents for example, U.S. Pat. Nos. 4,178,108 and 4,189,246 assigned to the assignee of the present invention. The control expedients described in these two patents may be used in the present invention with each selection step by each of the two helical print elements of the present invention being considered the equivalent of a selection step on the print wheel in the patents.

While the invention has been particularly shown and described with reference to a preferred embodiment it will be understood by those skilled in the art that various other changes in form and detail may be made without departing from the spirit and scope of the invention.

What is claimed is:

1. In an impact printer having a print member comprising type characters to be printed and a print hammer operable to impact selected ones of said type characters against a printing medium, the improvement wherein said print member comprises a first helical element having a first font of type characters arranged around its periphery, said first helical element being rotatably mounted so as to be linearly movable along an axis adjacent to said print medium, a second helical element having a second font of type characters arranged around its periphery in the same direction as said first font, said second helical element being rotatably mounted along said axis in a position interspaced with said first helical element, means for rotating and linearly moving said first helical element independently of said second helical element, and means for rotating and linearly moving said second helical element independently of said first helical element, so that said helical elements are rotatable and linearly movable along said axis independent of each other.

2. The impact printer of claim 1 wherein said first and second helical elements have the same radius.

3. The impact printer of claim 1 wherein said printing medium is a sheet and said print hammer is on a side of said sheet opposite to the side at which the print member is positioned.

4. The impact printer of claim 2 having means for maintaining one of said helical elements in a stationary position while the other helical element is being rotated by a means for rotating said other helical element.

5. The impact printer of claim 4 further including means for driving the print hammer to impact the printing medium with a type character on said stationary helical element.

6. The impact printer of claim 5 wherein the means for rotating said other helical element are adapted to rotate said helical element until the next successive type character to be printed is brought into the next successive print position.

7. The impact printer of claim 2 wherein said first and second print elements respectively pass through alternate print positions.

8. The impact printer of claim 2 wherein at least said first helical element has said first font extending for at least two turns around its periphery.

* * * * *